United States Patent [19]

Duthie et al.

[11] Patent Number: 4,903,368

[45] Date of Patent: Feb. 27, 1990

[54] ROAD SWEEPING VEHICLES

[75] Inventors: Anthony J. Duthie, Horsham; Clive F. Offley, Croydon, both of United Kingdom

[73] Assignee: Johnston Engineering Limited, Dorking, United Kingdom

[21] Appl. No.: 368,981

[22] Filed: Jun. 15, 1989

[30] Foreign Application Priority Data

Jun. 16, 1988 [GB] United Kingdom ..... 8814308
Jul. 15, 1988 [GB] United Kingdom ..... 8816901

[51] Int. Cl.[4] ..... E01H 1/08

[52] U.S. Cl. ..... 15/339; 15/340.4; 60/456

[58] Field of Search ..... 15/340.1, 340.3, 340.4, 15/339, 413; 60/456

[56] References Cited

U.S. PATENT DOCUMENTS

| | | | |
|---|---|---|---|
| 3,165,775 | 1/1965 | Lutz | 15/340.4 |
| 3,197,798 | 8/1965 | Brown et al. | 15/340.3 X |
| 3,977,039 | 8/1976 | Block | 15/346 |
| 4,555,825 | 12/1985 | Van Raaij | 15/340.3 X |

*Primary Examiner*—Chris K. Moore
*Attorney, Agent, or Firm*—Young & Thompson

[57] ABSTRACT

A suction type road sweeping vehicle generally has a self propelled chassis with road wheels. Mounted on the chassis is an air tight container for collecting dust etc. swept up by the vehicle. Dust etc. is sucked up into the container via pick up conduits and nozzles, the suction being provided by a fan. When hydraulically driven brushes and the like are used the hydraulic oil must be cooled. This is effected by introducing water into the conduits to mix with the cooling stream of air flowing into the container, separating the cooled water from the air and debris and utilizing the cooled water to cool the hydraulic oil.

6 Claims, 2 Drawing Sheets

ROAD SWEEPING VEHICLES

The invention relates to suction type, self propelled road sweeping vehicles, and particularly to an oil cooling system for hydraulic oil used in the hydraulic systems used in such vehicles.

Many known road sweeping vehicles operate by means of an exhauster fan generating a vacuum within an air tight container, which is mounted on a chassis of a vehicle, and which sucks debris from the roads through suction conduits. Many vehicles or machines of this type utilise oil hydraulics for propelling the vehicle, driving the scarifying brushes and also for driving the suction fan. The use of hydraulics provides controllable systems and to a certain extent it is often the only way to package the various mechanical features required of the machine to compact dimensions as is demanded nowadays.

A disadvantage of using hydraulics to the extent described above is that a build up of heat occurs in hydraulic systems which must be dissipated. This is a known characteristic of hydraulic systems and obviously heat can be extracted from the systems by using a satisfactory heat exchanger of which many types are available.

For example, U.S. Pat. No. 4,555,825 discloses a road sweeper of the vacuum type in which cooling means for the oil of its hydraulic systems are provided which utilises the exhaust air from the blower. The cooling means basically comprises a series of pipes through which the oil flows, which are placed in the exhaust part of the fan and cooled as the exhausted air rushes past. Thus, the faster the sweeper operates, the hotter the oil becomes, but also the faster the air flows across the pipes. One of the most important disadvantages of this systems is that the heat exchanger disrupts the air flow. In sweepers of this type, in order to maximise the efficiency of the sweeper the air flow, whether before entry into the fan or after it has been exhausted, must not be interrupted. Another disadvantage with this system is that dust and dirt which enters the suction system and is not properly filtered out before the air passes through the fan tends to contaminate the cooling system again leading to inefficient operation.

Other types of cooling systems used include air cooled units combined with the engine's radiator, air cooled units cooled by a separate electrically driven fan which is thermostatically operated, water cooled units which utilise the engine's cooling system and water cooled units which are implanted in the dust suppressing water spray reservoir which will become heated and in which the water is used up during the work cycle of the machine.

Some of these air systems have the same disadvantages as discussed above in relation to U.S. Pat. No. 4,555,825 and additionally in some systems the air is heated by the ineffeciencies in the fan system, which leads to further ineffieciences in the cooling system. One suggested solution is to mount a cooler in the inlet to the fan, however this is usually inpractical and again interrupts the air flow and therefore the suction performance.

It is therefore an object of the invention to provide an improved system for cooling the oil used in the hydraulic systems in a suction type road sweeping vehicle, in which interruption of the flow of air is minimised, in order to maximise suction efficiency of the system.

Thus, the present invention provides a suction type road sweeping vehicle comprising a self propelled chassis, an air tight container mounted on the chassis and communicating with a fan for generating a vacuum within said container, at least one suction conduit extending at one end into the container and being provided at the other end with a suction pick-up nozzle, at least one hydraulically driven component and a hydraulic oil cooling system comprising means for introducing water into the at least one suction conduit such that it mixes with a cooling stream of air flowing through the at least one conduit into the air tight container, means for separating cooled water from the air and debris carried thereby and means for cooling hydraulic oil from the at least one hydraulically driven component utilising the cooled water.

A preferred embodiment of the invention will now be described in detail with reference to the accompanying drawings in which.

Figure 1:
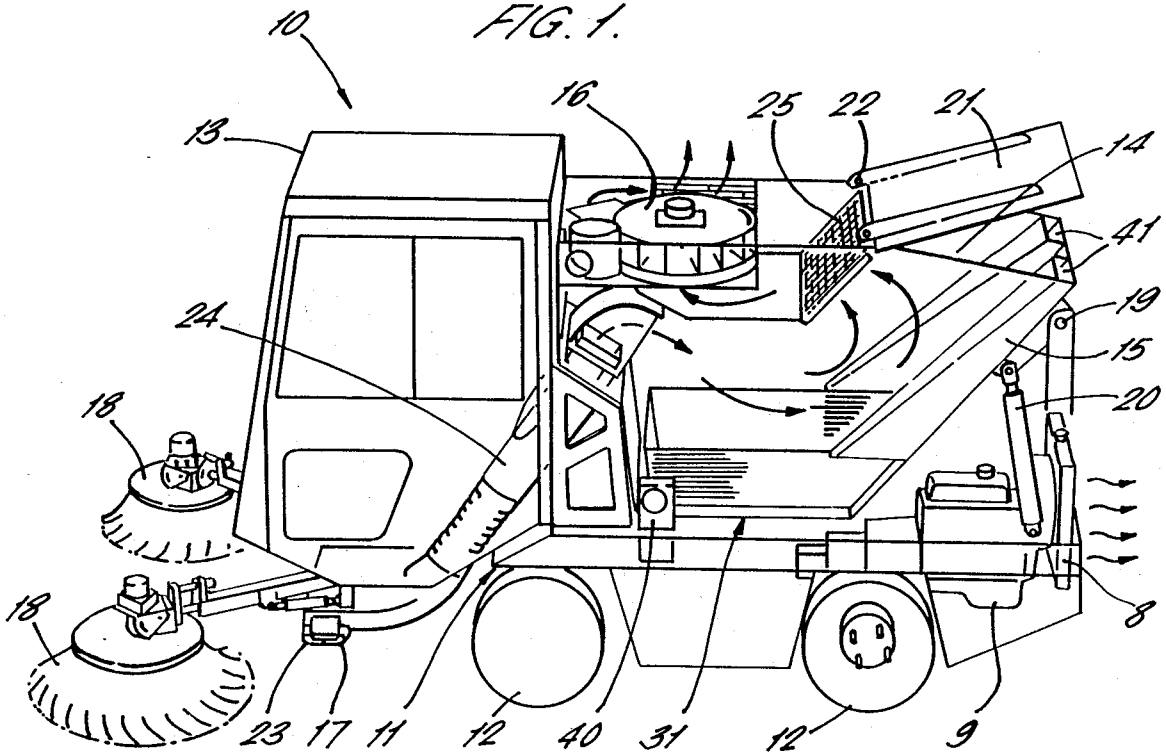
FIG. 1 is a schematic side view of a typical road sweeping vehicle.

A suction road sweeping vehicle 10 comprises a self propelled chassis 11 including road wheels 12 and drivers cab 13, on which are mounted a tipping body 15, a suction fan assembly 16, a pair of suction nozzles 17 (only one of which is shown), and a pair of low profile brush units 18. Chassis 11 is propelled by a single propulsion engine 9 based at the rear of the chassis 11, the cooling radiator 8 of engine 9 facing away from the vehicle.

The tipping body 15 is a steel monococque assembly which is pivotable about a horizontal axis 19 adjacent its rear end. The tipping operation is carried out by activating a pair of hydraulic cylinders 20, only one of which is shown.

The interior of the tipping body 15 provides an air tight container 14 for dust etc. swept up by the vehicle 10 and is sealed off by a rear door 21. The rear door 21 is pivoted about a horizontal axis 22 such that when the body 15 is tipped about axis 19, the rear door 22 can be operated such that it opens to permit egress of material contained in the air tight container 14 when it is tipped.

The suction nozzle 17 is supported on skids 23, which run along the ground. The suction nozzle 17 is connected to one end of an inlet duct 24 to form the pick up and conveyance system for the swept materials. The nozzle 17 is situated beneath the cab 13 and is centrally located between the pair of brush units 18. Nozzle 17 also has a hinged inlet flap (not shown) controlled by an in-cab control lever for ingestion of bulky matter to the nozzle 17.

The brush units 18 comprise a pair of kerb side floating forward mounted channel brushes which are driven by low profile hydraulic motors with speed, position and ground pressure controlled from the drivers cab 13.

In operation, the suction fan 16 generates a vacuum within the air tight container 14 which causes air and debris carried thereby to be sucked through the nozzle 17, up the inlet duct 24 and into the air tight container 14. The air then passes through suction filter mesh 25 which prevents most of the dust and debris from passing through into the suction fan 16, before being expelled to the atmosphere.

Figure 2:
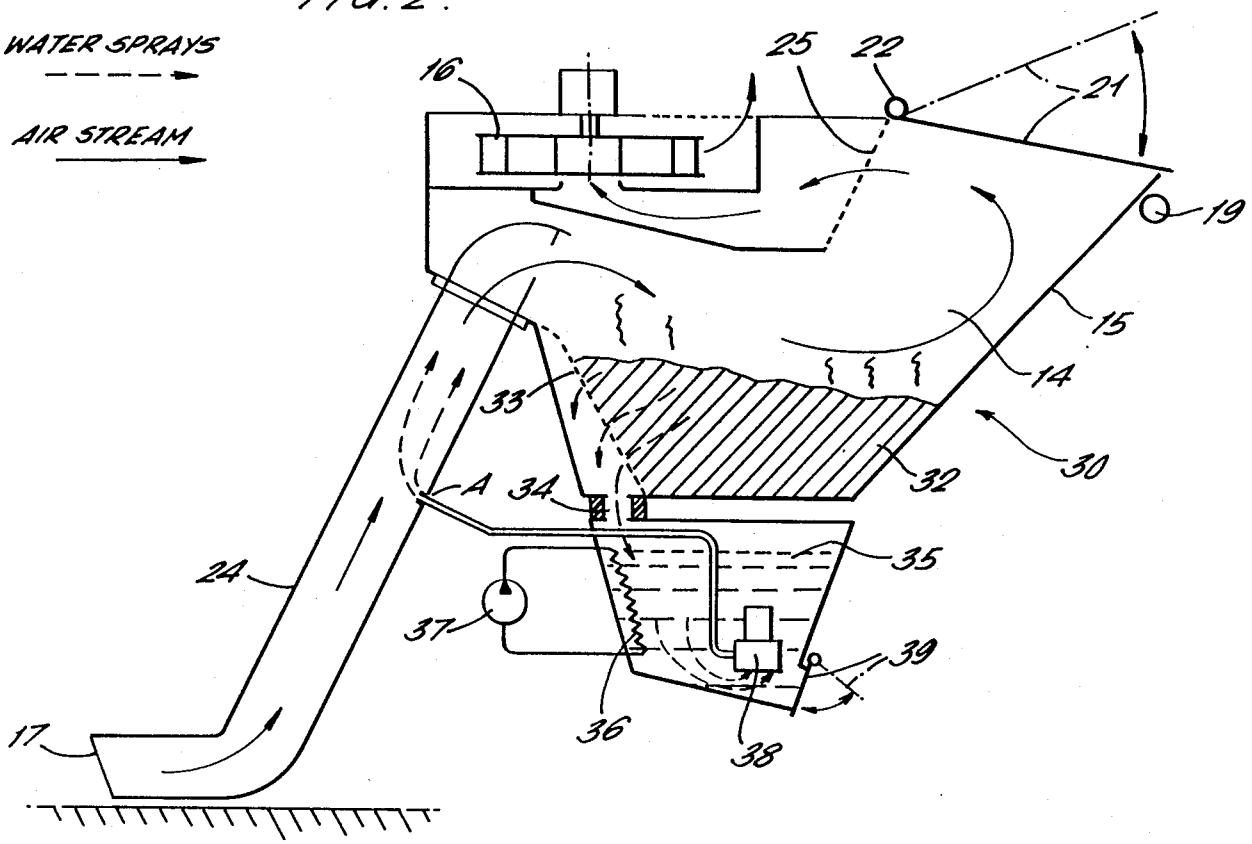
FIG. 2 is a schematic representation of a cooling system for a road sweeping vehicle, with certain parts omitted for clarity.

FIG. 2 shows a cooling system 30 for use in the above described road sweeping vehicle 10, which is equipped with a water recirculating system 31 which is used to prevent the carry-over of dust and debris in the suction conveying system and through the fan assembly 16.

Water is injected by pump 38 from a reservoir 35 into the inlet duct 24. The water mixes with the incoming air and debris carried thereby, where due to the high speed of the air stream it is chilled. The air, debris and water conglomerate continues up the inlet duct 24 and into the air tight container 14. The air stream continues through filter 25 to the suction fan assembly 16 before being exhausted to atmosphere, whilst the wet debris 32 collects in the bottom of the container 14. A portion of the container 14 is screened off by a screen filter 33, which prevent the debris 32 from passing through it, but which allows the water to filter through. The water passes through a pipe 34 which connects the container 14 to the central reservoir 35 ready to be injected again into the inlet duct 24. Thus the water is continually re-circulating through the system.

Mounted in reservoir 35 is a heat exchanger 36 which is connected to the hydraulic system comprising the various hydraulic components used in vehicle 10 (which are not limited to those listed above). The re-circulation water is cooled by the air stream in inlet duct 24, which is self regulating to heat extraction by the volume of air entering the duct 24. The chilled water collects in reservoir 35, where it is used to cool the hot hydraulic oil passing through heat exchanger 36. The water is then re-cooled as it re-enters the inlet duct 24.

Experiments have shown that with quite high thermal inputs the water remains around ambient temperature and can even fall below it on occasion.

The water contained in the reservoir generally lasts the duration of a sweeping cycle and use of this system has led to more effective sweeping without dust emission from the fan exhaust.

Reservoir 35 has a quick-dump discharge valve 39 which is operated from the cab 13 and allows the removal of water. A fill-port 40 (see FIG. 1) is provided to allow easy access to fill the reservoir 35.

Cleaning of the filter section is by two sludge drainage channels 41 interconnected to the creened off portion of the container 14 and accessed from the door 21.

In an alternative embodiment of the invention the size of the reservoir 35 is adjusted such that the temperature of the water is deliberately allowed to be raised above the ambient temperature by the heat exchanger 36. This is useful in a cold climate and would prevent the water in the inlet duct 24 from freezing and prevent the debris 32 collecting in the bottom of container 14 from freezing into a solid mass.

We claim:

1. A suction type road sweeping vehicle comprising a self repelled chassis, an air-tight container mounted on the chassis and communicating with a fan for generating a vacuum within said container, at least one suction conduit extending at one end into the container and being provided at the other end with a suction pick-up nozzle, at least one hydraulically driven component and a hydraulic oil cooling system comprising means for introducing water into the at least one suction conduit such that it mixes with a cooling stream of air flowing through the at least one conduit into the air tight container, means for separating cooled water from the air and debris carried thereby and means for cooling hydraulic oil from the at least one hydraulically driven component utilising the cooled water.

2. A suction type road sweeping vehicle as claimed in claim 1 wherein the cooling means is a heat exchanger.

3. A suction type road sweeping vehicle as claimed in claim 1 in which the heat exchanger is situated in a tank which collects the cooled water after its separation from the air and debris.

4. A suction type road sweeping vehicle as claimed in claim 1 wherein means are provided to re-circulate the water through the cooling system.

5. A method of cooling hydraulic oil in a road sweeping vehicle as claimed in claim 1 comprising the steps of introducing water into a fast moving cooling stream of air passing through an inlet duct and separating cooled water from the air and debris carried thereby and effecting a heat exchange process, transferring heat from the oil to the water.

6. A method of cooling hydraulic oil in a road sweeping vehicle as claimed in claim 5 further comprising re-circulating the water to re-cool it.

* * * * *